US010395577B2

(12) United States Patent
Cheon et al.

(10) Patent No.: US 10,395,577 B2
(45) Date of Patent: Aug. 27, 2019

(54) ORGANIC LIGHT EMITTING DISPLAY DEVICE AND METHOD OF DRIVING THE SAME

(71) Applicant: SAMSUNG DISPLAY CO., LTD., Yongin-si, Gyeonggi-do (KR)

(72) Inventors: Man-Bok Cheon, Yongin-si (KR); So-Young Kim, Seoul (KR); Jin-Ho Lee, Cheonan-si (KR); Seung-Ho Park, Suwon-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 215 days.

(21) Appl. No.: 15/371,967

(22) Filed: Dec. 7, 2016

(65) Prior Publication Data

US 2017/0162098 A1 Jun. 8, 2017

(30) Foreign Application Priority Data

Dec. 8, 2015 (KR) ..... 10-2015-0173829

(51) Int. Cl.

| | |
|---|---|
| ***G09G 5/02*** | (2006.01) |
| ***G09G 3/20*** | (2006.01) |
| ***G09G 3/3233*** | (2016.01) |
| ***G09G 3/3258*** | (2016.01) |
| ***G09G 3/3266*** | (2016.01) |

(Continued)

(52) U.S. Cl.

CPC ..... *G09G 3/2003* (2013.01); *G09G 3/3225* (2013.01); *G09G 3/3233* (2013.01); *G09G 3/3258* (2013.01); *G09G 3/3266* (2013.01); *G09G 3/3275* (2013.01); *G09G 2300/0452* (2013.01); *G09G 2300/0819* (2013.01); *G09G 2320/0233* (2013.01); *G09G 2320/043* (2013.01); *G09G 2330/021* (2013.01); *G09G 2330/025* (2013.01); *G09G 2360/16* (2013.01)

(58) Field of Classification Search

CPC combination set(s) only.

See application file for complete search history.

(56) References Cited

U.S. PATENT DOCUMENTS

2004/0201582 A1* 10/2004 Mizukoshi ..... G09G 3/3233 345/211
2008/0291135 A1* 11/2008 Kim ..... G09G 3/2022 345/76
2012/0044270 A1* 2/2012 Arkhipov ..... G09G 3/32 345/690

FOREIGN PATENT DOCUMENTS

KR 1020140080312 6/2014

* cited by examiner

*Primary Examiner* — Temesghen Ghebretinsae
*Assistant Examiner* — Sosina Abebe
(74) *Attorney, Agent, or Firm* — F. Chau & Associates, LLC

(57) ABSTRACT

A method of driving an OLED display device includes receiving image data. A load value is determined for each sub-pixel. A first load value is set to a largest load value determined for each sub-pixel. A first correction factor is calculated that decreases as the first load value increases, when the first load value is greater than a first threshold. A second load value is calculated based on the image data and current contribution weights for the sub-pixels. A second correction factor is calculated that decreases as the second load value increases, when the second load value is greater than a second threshold. Either the first correction factor or the second correction factor is selected. The image data is converted into output image data based on the correction factor. An image corresponding to the output image data is displayed.

17 Claims, 9 Drawing Sheets

(51) Int. Cl.
*G09G 3/3225* (2016.01)
*G09G 3/3275* (2016.01)

ORGANIC LIGHT EMITTING DISPLAY DEVICE AND METHOD OF DRIVING THE SAME

CROSS REFERENCE TO RELATED APPLICATION

This application claims priority under 35 U.S.C. § 119 to Korean patent Application No. 10-2015-0173829, filed on Dec. 8, 2015, the disclosure of which is hereby incorporated by reference herein in its entirety.

TECHNICAL FIELD

Example embodiments of the present inventive concept relate to display devices. More particularly, example embodiments of the present inventive concept relate to an organic light emitting display device and method for driving the organic light emitting display device.

DISCUSSION OF THE RELATED ART

An organic light emitting diode (OLED) display device is a display device that generates images using organic light emitting diodes (OLEDs). The organic light emitting diode includes an organic layer disposed between two electrodes, namely, an anode and a cathode. The holes from the anode may be combined with the electrons from the cathode within the organic layer that is disposed between the anode and the cathode. As the holes combine with the electrons, light is emitted.

The power consumption of the organic light emitting display device increases as a size or a resolution of the display device increases. In this case, a magnitude of a driving current flowing through a display panel can sharply increase as a load value of image data increases. Accordingly, methods of restricting the driving current of the organic light emitting display device by adjusting the input image data have been developed. However, the luminance of the display device might be excessively decreased when the magnitude of the driving current is restricted.

SUMMARY

A method of driving an organic light emitting display device includes receiving input image data representing an image comprising a plurality of pixels, each of the plurality of pixels comprising a plurality of sub-pixels. A load value is determined for each of the plurality of sub-pixels for each of the plurality of pixels based on the received input image data. A first load value is set as equal to a largest one of the load values determined for each of the plurality of sub-pixels for each of the plurality of pixels. A first correction factor is calculated that decreases as the first load value increases, when the first load value is greater than a first threshold load value. A second load value is calculated based on the input image data representing the plurality of sub-pixels of the plurality of pixels and current contribution weights for the plurality of sub-pixels. A second correction factor is calculated that decreases as the second load value increases, when the second load value is greater than a second threshold load value. Either the first correction factor or the second correction factor is selected as an output correction factor. The input image data is converted into output image data based on the output correction factor. An image corresponding to the output image data is displayed.

An organic light emitting display device includes a display panel including a plurality of pixels. A scan driver is configured to provide a scan signal to each of the plurality of pixels. A data driver is configured to provide a data signal to each of the plurality of pixels. A data adjuster is configured to set an output correction factor such that a constant driving current flows through the display panel when a load value of input image data provided thereto is greater than a first threshold load value, and configured to convert the input image data into output image data based on the output correction factor. A timing controller is configured to control the scan driver and the data driver to display an image corresponding to the output image data on the display panel.

A method for driving an organic light emitting display device includes receiving image data. Image driving data is generated for displaying the received image data on a plurality of pixels. Pixel load values are determined from the generated image driving data. Two different correction factors are calculated for reducing the pixel load values when the pixel load values exceed two different predetermined thresholds, respectively. The two different correction factors are switched between based on whether the image data is single-color image data or multi-color image data.

BRIEF DESCRIPTION OF THE DRAWINGS

A more complete appreciation of the present disclosure and many of the attendant aspects thereof will be readily obtained as the same becomes better understood by reference to the following detailed description when considered in connection with the accompanying drawings, wherein.

DESCRIPTION OF EMBODIMENTS

Exemplary embodiments will be described more fully hereinafter with reference to the accompanying drawings, in which various embodiments are shown.

Figure 1:
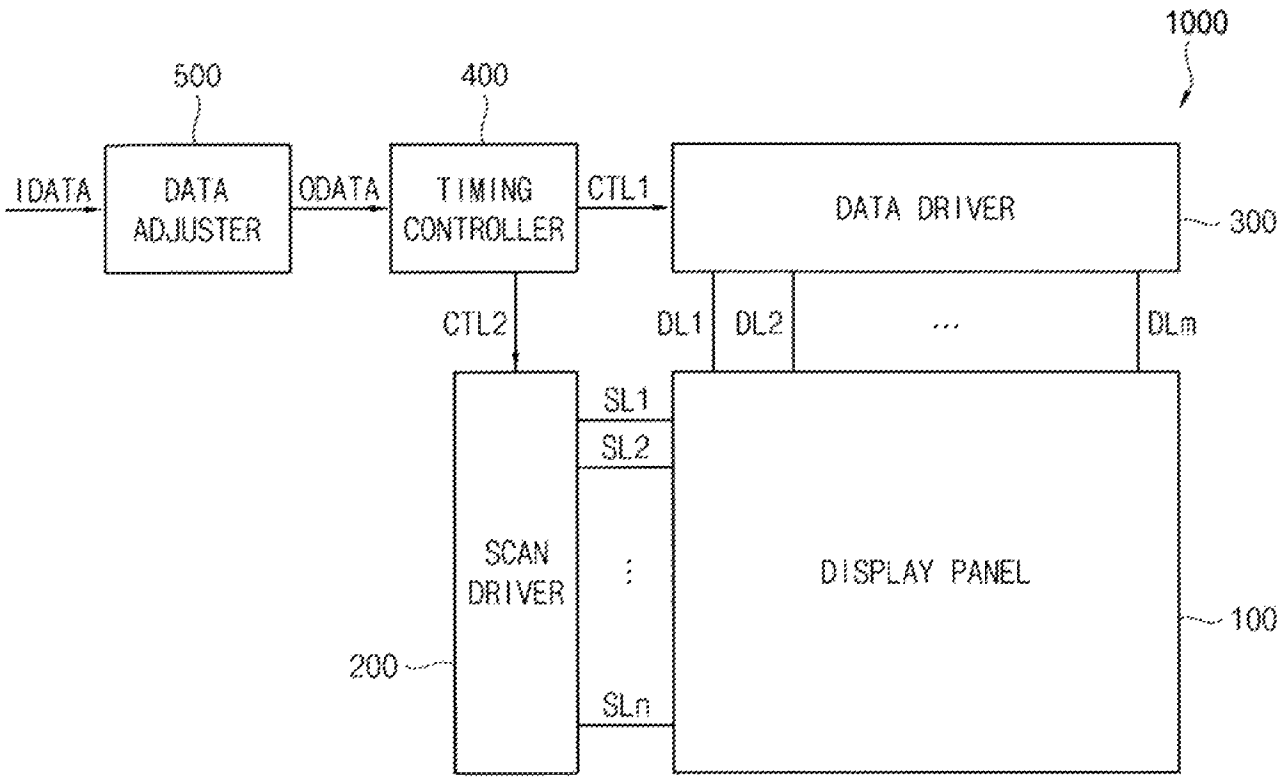
FIG. 1 is a block diagram illustrating an organic light emitting display device according to exemplary embodiments of the present invention.

FIG. 1 is a block diagram illustrating an organic light emitting display device according to exemplary embodiments of the present invention.

Referring to FIG. 1, the organic light emitting display device 1000 may include a display panel 100, a scan driver 200, a data driver 300, a timing controller 400, and a data adjuster 500.

The display panel 100 may be connected to the scan driver 200 via scan lines SL1 through SLn. The display panel 100 may be connected to the data driver 300 via data lines DL1 through DLm. The display panel 100 may include n*m pixels that are arranged at locations corresponding to crossing points of the scan lines SL1 through SLn and the data lines DL1 through DLm.

The scan driver 200 may provide a scan signal to the pixels via the scan lines SL through SLn based on a second control signal CTL2.

The data driver 300 may provide a data signal to the pixels via the data lines DL1 through DLm based on a first control signal CTL1.

The data adjuster 500 may set an output correction factor such that a constant driving current flows through the display panel 100 when a load value of input image data IDATA is greater than a threshold load value. The data adjuster 500 may convert the input image data IDATA into output image data ODATA based on the output correction factor.

In one exemplary embodiment of the present invention, the data adjuster 500 may restrict a current flowing into the display panel 100 using the output correction factor that is either a first correction factor derived by a maximum load manner or a second correction factor derived by a current contribution manner. In the maximum load manner, the correction factor (e.g., the first correction factor) may be calculated based on a maximum value of load values for sub-pixel colors of the input image data IDATA. In the current contribution manner, the correction factor (e.g., the second correction factor) may be calculated based on a load value derived by applying current contribution weights to image data for the sub-pixel colors of the input image data IDATA.

In one exemplary embodiment of the present invention, when the input image data IDATA correspond to single color data, the data adjuster 500 may generate the output image data ODATA using the first correction factor derived by the maximum load manner. When the input image data IDATA correspond to mixed color data, the data adjuster 500 may generate the output image data ODATA using the second correction factor derived by the current contribution manner. Here, the single color may be one of the colors generated by sub-pixels of each pixel. For example, when each pixel includes a red color sub-pixel, a green color sub-pixel, a blue color sub-pixel, and a white color sub-pixel, the single color can correspond to red, green, blue, or white.

Hereinafter, a structure of data adjuster 500 will be described in more detail with reference to the FIGS. 2 and 10.

The timing controller 400 may generate the first control signal CTL1 and the second control signal CTL2 and may control the scan driver 200 and the data driver 300 to display an image corresponding to the output image data ODATA.

In addition, the organic light emitting display device 1000 may further include a power supply providing high power voltage and low power voltage to the display panel 100, an emission driver providing an emission control signal to the pixels, etc.

Therefore, the organic light emitting display device 1000 may set the output correction factor using the maximum load manner or the current contribution manner according to a type of the input image data IDATA. Accordingly, when the organic light emitting display device 1000 displays images corresponding to the mixed color, the organic light emitting display device 1000 may prevent overcurrent flowing through the display panel 100, thereby preventing the deterioration of pixels and reducing the power consumption of the display panel 100. In addition, when the organic light emitting display device 1000 displays images corresponding to the single color, the organic light emitting display device 1000 can reduce the luminance degradation and increase the visibility of the display device by setting the threshold load value to a different value for each of the sub-pixel colors.

Although the example embodiments of FIG. 1 describe that the data adjuster 500 may adjust the input image data IDATA and provide the output image data ODATA to the timing controller 400, the data adjuster 500 can adjust the image data in various locations. For example, the data adjuster may be included in the timing controller or the data driver.

Figure 2:
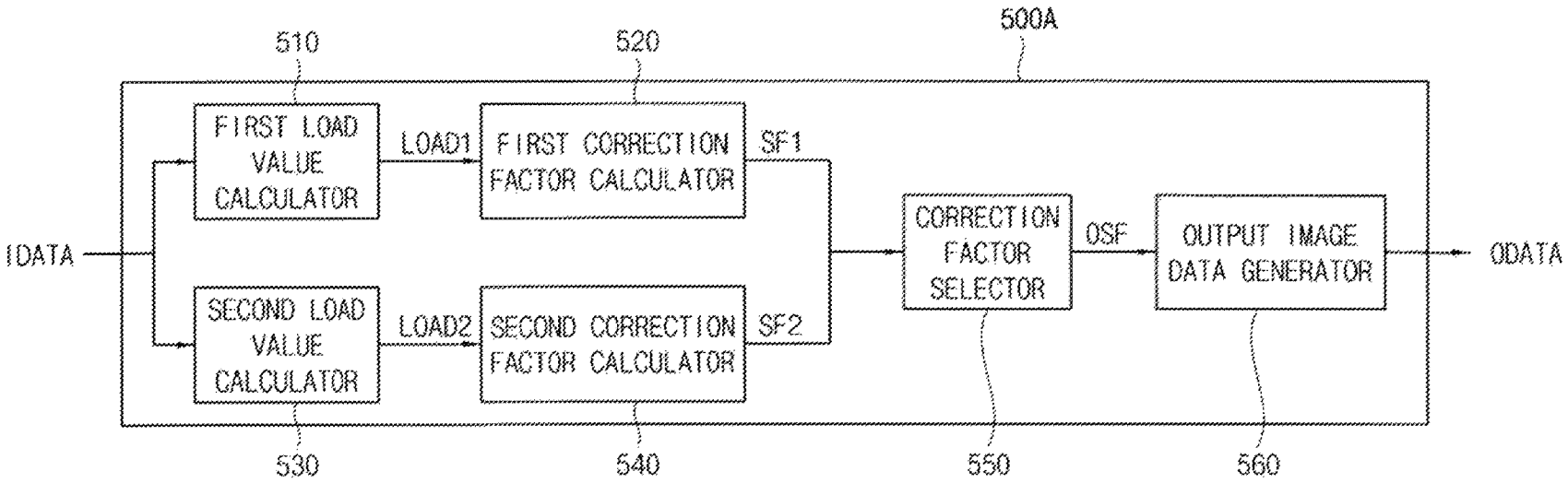
FIG. 2 is a block diagram illustrating a data adjuster included in an organic light emitting display device of FIG. 1, according to exemplary embodiments of the present invention.
Figure 3:
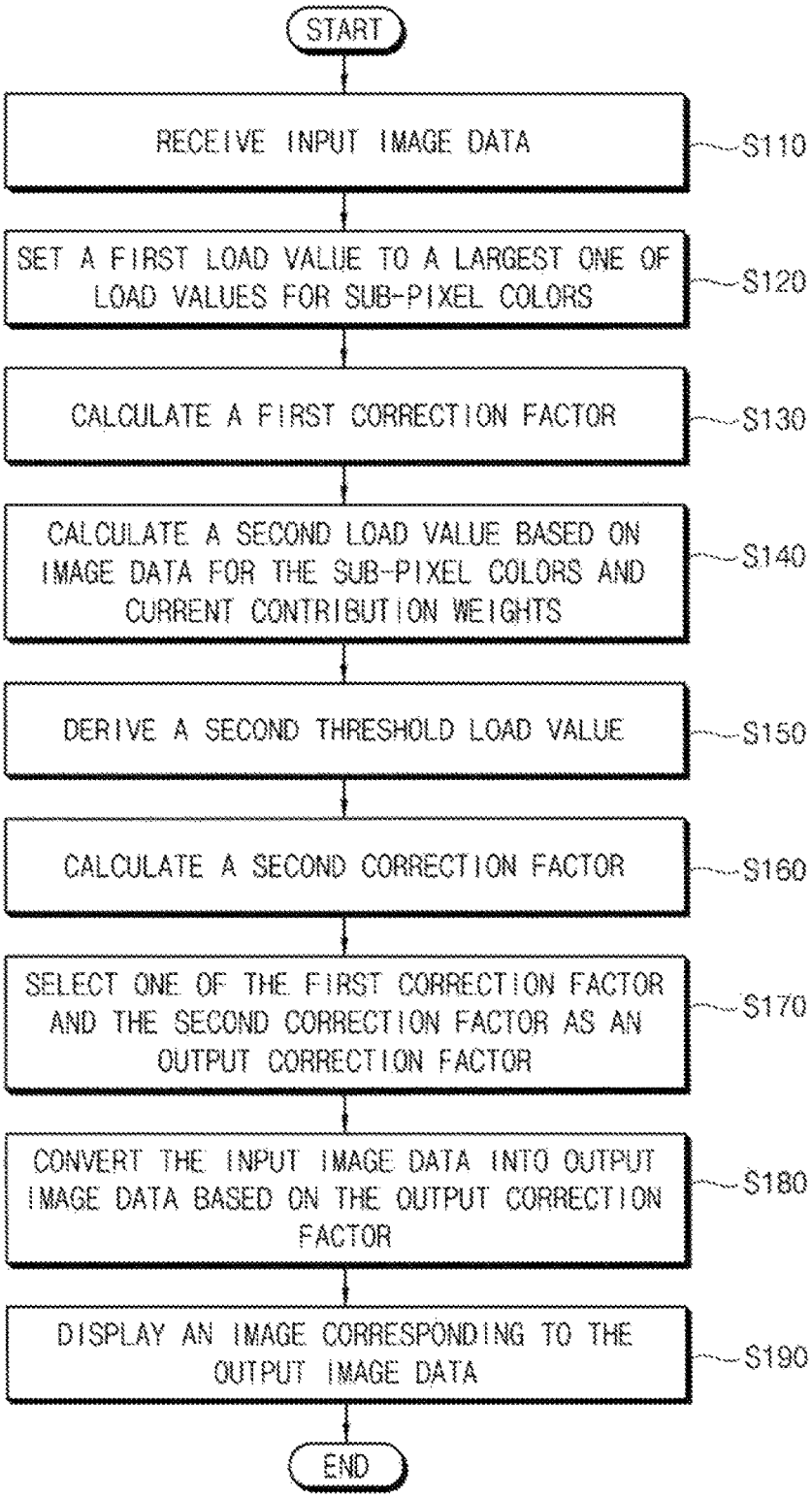
FIG. 3 is a flow chart illustrating a method of driving an organic light emitting display device by a data adjuster of FIG. 2, according to exemplary embodiments of the present invention.

FIG. 2 is a block diagram illustrating an example of a data adjuster 500 included in an organic light emitting display device of FIG. 1. FIG. 3 is a flow chart illustrating one example of a method of driving an organic light emitting display device performed by a data adjuster of FIG. 2, according to exemplary embodiments of the present invention.

Referring to FIGS. 2 and 3, the data adjuster 500A may include a first load value calculator 510, a first correction factor calculator 520, a second load value calculator 530, a second correction factor calculator 540, a correction factor selector 550, and an output image data generator 560.

The data adjuster 500A may receive input image data IDATA (S110).

The first load value calculator 510 may set a first load value LOAD1 to a largest load value of the load values for sub-pixel colors of the input image data IDATA (S120). For example, each pixel may include a red color sub-pixel, a green color sub-pixel, a blue color sub-pixel, and a white color sub-pixel. The first load value calculator 510 may calculate the first load value LOAD1 according to [Equation 1].

$$LOAD1 = \mathrm{MAX}\left\{\left(\frac{\sum Rin}{SUM(R\max)}\right), \left(\frac{\sum Gin}{SUM(G\max)}\right), \left(\frac{\sum Bin}{SUM(B\max)}\right), \left(\frac{\sum Win}{SUM(W\max)}\right)\right\}, \quad \text{[Equation 1]}$$

wherein Rin, Gin, Bin, and Win respectively indicate red color image data, green color image data, blue color image data, and white color image data included in the input image data. SUM(R max), SUM(G max), SUM(B max), and SUM(W max) respectively indicate a first total sum of maximum values for red color image data, a second total sum of maximum values for green color image data, a third total sum of maximum values for blue color image data, and a fourth total sum of maximum values for white color image data. For example, the first load value LOAD1 may be greater than or equal to 0, and lesser than or equal to 1.

The first correction factor calculator 520 may calculate a first correction factor SF1 that decreases as the first load value increases when the first load value LOAD1 is greater than a first threshold load value (S130). Here, the first threshold load value and the first correction factor SF1 are greater than or equal to 0, and lesser than or equal to 1. The first correction factor calculator 520 may set the first correction factor SF1 such that a constant driving current flows through the display panel when the first load value LOAD1 is greater than the first threshold load value. In one exemplary embodiment of the present invention, the first correction factor SF1 may be set to 1 when the first load value LOAD1 is lesser than or equal to the first threshold load value. The first correction factor SF1 may be set to a value derived by dividing the first threshold load value by the first load value LOAD1 when the first load value LOAD1 is greater than the first threshold load value.

The second load value calculator 530 may calculate a second load value based on image data for the sub-pixel colors of the input image data IDATA and current contribution weights for the sub-pixel colors (S140). Here, each current contribution weight indicates a degree to which each sub-pixel color contributes to the driving current. For example, the second load value calculator 530 may calculate the second load value LOAD2 according to [Equation 2].

$$LOAD2 = \frac{(Wr * \sum Rin) + (Wg * \sum Gin) + (Wb * \sum Bin) + (Ww * \sum Win)}{(Wr + Wg + Wb + Ww)(SUM(\max))}, \quad \text{[Equation 2]}$$

wherein Rin, Gin, Bin, and Win respectively indicate red color image data, green color image data, blue color image data, and white color image data included in the input image data. Wr, Wg, Wb, and Ww respectively indicate a first current contribution weight for red color, a second current contribution weight for green color, a third current contribution weight for blue color, a fourth current contribution weight for white color, and SUM(max) indicates a total sum of maximum value of image data.

The second correction factor calculator 540 may derive a second threshold load value corresponding to a threshold current value (S150) and may calculate a second correction factor SF2 that decreases as the second load value LOAD2 increases, when the second load value LOAD2 is greater than a second threshold load value (S160). In one exemplary embodiment of the present invention, the second correction factor SF2 may be set to 1 when the second load value LOAD2 is smaller than or equal to the second threshold load value and the second correction factor SF2 may be set to a value derived by dividing the second threshold load value by the second load value LOAD2 when the second load value LOAD2 is greater than the second threshold load value.

A magnitude of the driving current flowing through the display panel may be restricted based on the threshold current value. The second threshold load value may be set to a load value corresponding to a point at which the magnitude of the driving current reaches the threshold current value. In one exemplary embodiment of the present invention, the second threshold load value may be determined such that a first ratio of the threshold current value to an estimated current value corresponding to the first threshold load value is substantially the same as a second ratio of the second threshold load value to the first threshold load value.

The correction factor selector 550 may select either the first correction factor SF1 or the second correction factor SF2 as the output correction factor SOF (S170). In one exemplary embodiment of the present invention, the correction factor selector 550 may select a smaller one of the first correction factor SF1 and the second correction factor SF2 as the output correction factor OSF. In this case, the overcurrent occurring when the image data correspond to mixed color data (e.g., cyan, magenta, yellow, etc.) can be prevented, thereby reducing deterioration of pixels.

The output image data generator 560 may convert the input image data IDATA into the output image data ODATA based on the output correction factor OSF (S180). In one exemplary embodiment of the present invention, the output image data generator 560 may generate the output image data ODATA by multiplying the input image data IDATA by either the first correction factor SF1 or the second correction factor SF2 (e.g., the output correction factor OSF).

The display panel may display an image corresponding to the output image data ODATA (S190). For example, the timing controller may generate control signals for displaying the output image data ODATA and may provide the control signals to the scan driver and the data driver.

Figure 4:
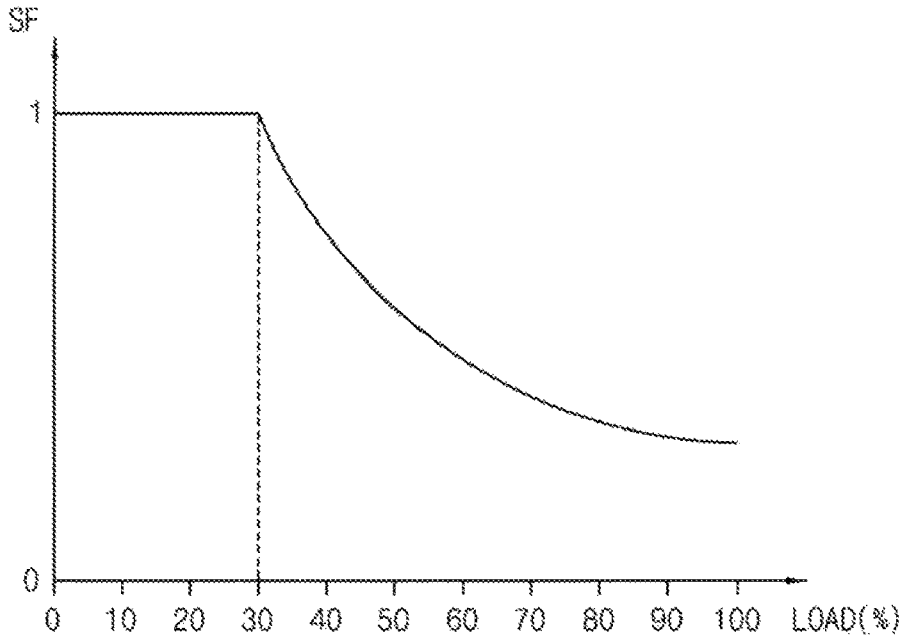
FIGS. 4 through 6 are graphs illustrating a driving current being restricted in a maximum load manner, according to exemplary embodiments of the present invention.
Figure 5:
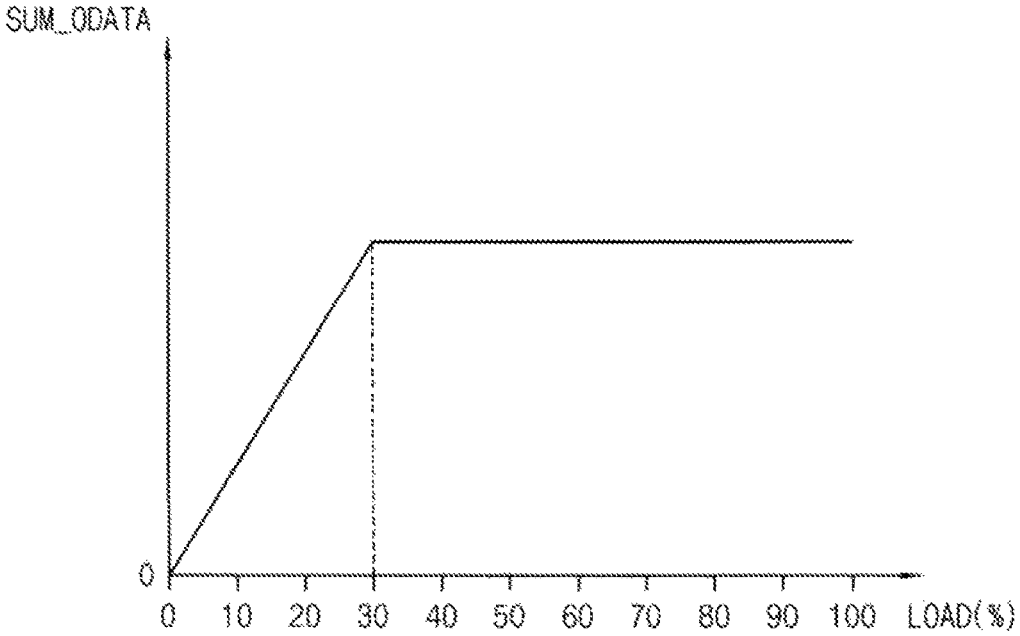
Figure 6:
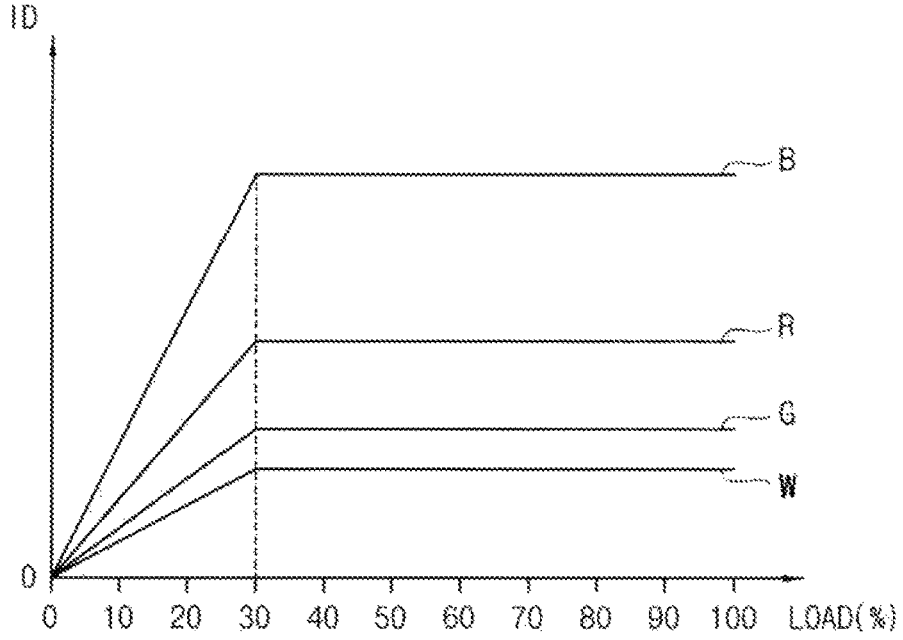

FIGS. 4 through 6 are graphs illustrating a driving current restricted in a maximum load manner, according to exemplary embodiments of the present invention.

Referring to FIGS. 4 through 6, in the maximum load manner, the first load value may be set to a largest load value for sub-pixel colors of the input image data. Thereafter, a first correction factor may be calculated based on the first load value and the first threshold load value that is predetermined. When the first load value is greater than the first threshold load value, a magnitude of the driving current flowing through the display panel may be uniform regardless of the first load value.

As shown in FIG. 4, the first correction factor SF may be calculated using the maximum load manner. When the first load value LOAD is greater than the first threshold load value, the first correction factor may be set such that a constant driving current flows through the display panel. For example, when the first load value LOAD is lesser than the first threshold load value (e.g., 30%), the first correction factor SF may be set to 1. When the first load value LOAD is greater than the first threshold load value (e.g., 30%), the first correction factor SF may be calculated by dividing the first threshold load value by the first load value LOAD.

As shown in FIG. 5, in the maximum load manner, the output image data may be generated by adjusting the input image data using the first correction factor. When a sum of the input image data linearly increases as the load value LOAD increases, a relationship between the load value LOAD and the sum SUM_ODATA of the output image data that is generated by applying the correction factor to the input image data, for example, as is described in FIG. 5. In one exemplary embodiment of the present invention, the output image data may be generated by multiplying the input image data IDATA by the first correction factor. For example, when the first load value LOAD is lesser than the first threshold load value (e.g., 30%), the first correction factor may be set to 1, and the sum SUM_ODATA of the output image data may increase as the first load value LOAD increases. In addition, when the first load value LOAD is greater than the first threshold load value (e.g., 30%), the first correction factor is in inversely proportional to the first load value LOAD and the sum SUM_ODATA of the output image data may be maintained at a substantially constant value.

As shown in FIG. 6, the driving current ID flowing through the display panel may be proportional to the sum SUM_ODATA of the output image data. For example, when the first load value LOAD is lesser than the first threshold load value 30%, the driving current ID flowing through the display panel may increase as the first load value LOAD increases because the sum SUM_ODATA of the output image data increases in proportion to the first load value LOAD. When the first load value LOAD is greater than the first threshold load value 30%, the first correction factor is inversely proportional to the first load value LOAD and the magnitude of the driving current ID may be maintained at a uniform value. Because the maximum load manner does not consider the efficiency difference among sub-pixel colors, the magnitudes of the driving currents ID for each sub-pixel colors are different from each other. For example, efficiencies of sub-pixel colors are higher in the order of "a white sub-pixel (W)>a green sub-pixel (G)>a red sub-pixel (R)>a blue sub-pixel (B)". In this case, the magnitude of the driving current ID is the greatest when the image data correspond to the blue color data is in the same load value condition. Also, the magnitude of the driving current ID is the smallest when the image data correspond to the white color data is in the same load value condition.

Therefore, if the input image data is adjusted using the maximum load manner without considering the efficiency difference among sub-pixel colors, the driving current can be restricted at the same threshold load value regardless a type of sub-pixel color. Accordingly, the luminance of the display device can decrease because the current is restricted even when the image data correspond to white color data or green color data of which efficiencies are relatively high and to which a current restriction operation is not needed.

Figure 7:
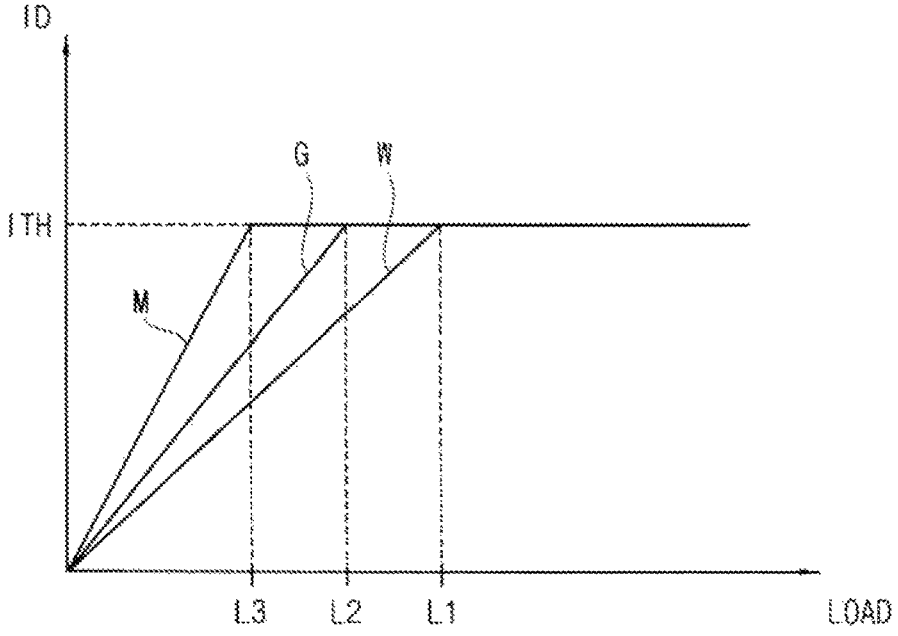
FIG. 7 is a graph illustrating a driving current being restricted in a current contribution manner, according to exemplary embodiments of the present invention.

FIG. 7 is a graph illustrating a driving current restricted in a current contribution manner, according to exemplary embodiments of the present invention.

Referring to FIG. 7, in the current contribution manner, the second load value LOAD may be calculated by applying current contribution weights to image data for the sub-pixel colors. Because the driving current ID is restricted at the threshold current value ITH in current contribution manner, the second threshold load value corresponding to the threshold current value ITH may be calculated according to the input image data. For example, when the input image data correspond to the white color data (W) of which emission efficiency is relatively high, the second threshold load value may be set to the first threshold value L1. When the input image data correspond to the green color data (G), the second threshold load value may be set to the second threshold value L2 that is less than the first threshold value L1. When the input image data correspond to the magenta color data (M) of which emission efficiency is relatively low, the second threshold load value may be set to the third threshold value L3 that is less than the second threshold value L2.

In the current contribution manner, the driving current may be restricted at the same threshold current value ITH regardless of the input image data. Thus, the second threshold load value may be adjusted according to the input image data. For example, an image having a mixed color pattern may be displayed using red color sub-pixel, green color sub-pixel, and blue color sub-pixel of which efficiencies are lower than the efficiency of white color sub-pixel. If the image having the mixed color pattern is displayed with relatively high luminance, the magnitude of the driving current ID and the power consumption may increase. To prevent this, when the image data correspond to the mixed color data, the second threshold load value may be set to a relatively small value in comparison when image data correspond to the single-color data. However, when the input image data is adjusted using the current contribution manner without considering efficiencies of sub-pixel colors, a first luminance corresponding to the mixed color data may be lower than a second luminance corresponding to single color data.

Figure 8:
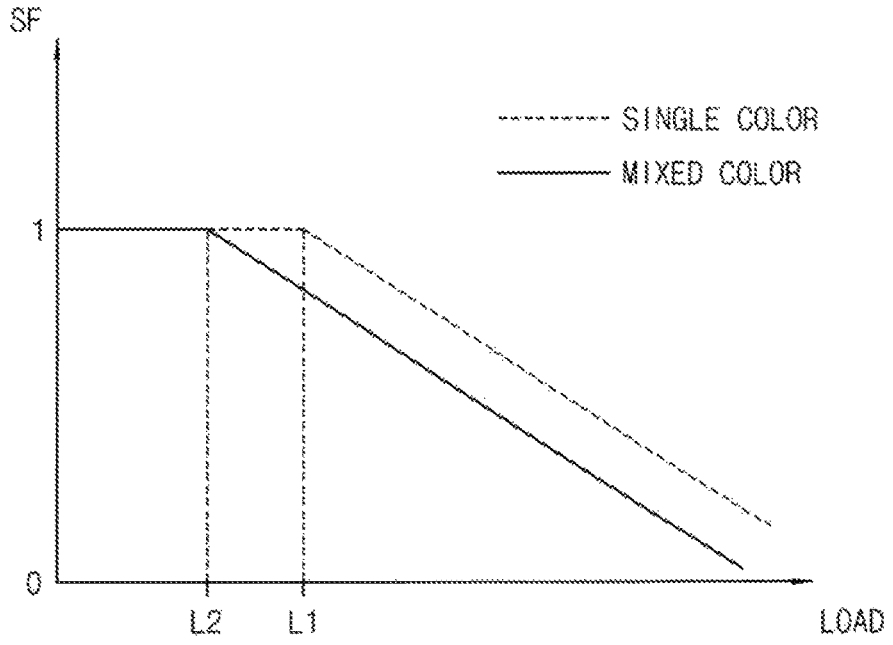
FIGS. 8 and 9 are graphs illustrating a driving current being restricted according to input image data, according to exemplary embodiments of the present invention.
Figure 9:
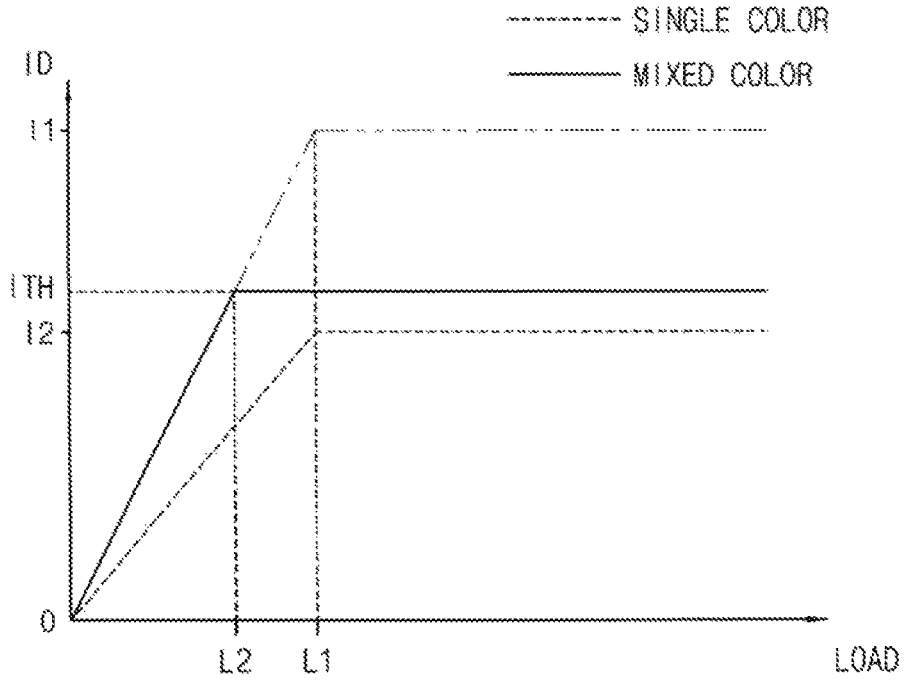

FIGS. 8 and 9 are graphs illustrating a driving current restricted according to input image data, according to exemplary embodiments of the present invention.

Referring to FIGS. 8 and 9, the input image data may be adjusted using either the maximum load manner or the current contribution manner, according to the input image data. For example, when the input image data correspond to the single-color data, the input image data may be adjusted using the maximum load manner. When the input image data correspond to the mixed color data, the input image data may be adjusted using the current contribution manner.

As shown in FIG. 8, when the input image data correspond to the single-color data, the load value LOAD may be calculated using the maximum load manner, and then the first threshold load value may be set to the first threshold value L1. Accordingly, the correction factor SF may decrease as the load value LOAD increases when the load value LOAD is greater than the first threshold value L1. The input image data correspond to the mixed color data, the load value LOAD, may be calculated using the current contribution manner, and then the second threshold load value may be set to the second threshold value L2 that is lower than the first threshold value L1 to restrict the driving current at the threshold current value. Accordingly, the correction value SF may decrease as the load value LOAD increases when the load value is greater than the second threshold value L2.

As shown in FIG. 9, when the input image data correspond to the single-color data, the driving current ID may be restricted using the maximum load manner. Therefore, the magnitude of the driving current ID flowing through the display panel may be uniform (e.g., the second current value I2) when the load value LOAD is greater than the first threshold value L1.

When the input image data correspond to the mixed color data, the driving current ID may be restricted using the current contribution manner. If the input image data correspond to the mixed image data and the driving current ID is restricted using the maximum load manner, the maximum magnitude of the driving current ID may be the first current value I1 corresponding to the first threshold value L1. In this case, the magnitude of the driving current ID is relatively large when the image data correspond to the mixed color data, and then the pixels can be deteriorated and/or the power consumption can increase. To prevent this, when the input image data correspond to the mixed color data, the driving current ID may be restricted using the current contribution manner, and the magnitude of the driving current ID flowing through display panel may be the threshold current value ITH when the load value LOAD is greater than the second threshold value L2. In one exemplary embodiment of the present invention, the second threshold load value may be determined such that a first ratio of the threshold current value to an estimated current value corresponding to the first threshold load value is substantially the same as a second ratio of the second threshold load value to the first threshold load value. For example, the first ratio of the threshold current value ITH to the first current value I1 may be substantially the same as the second ratio of the second threshold value L2 to the first threshold value L1.

Figure 10:
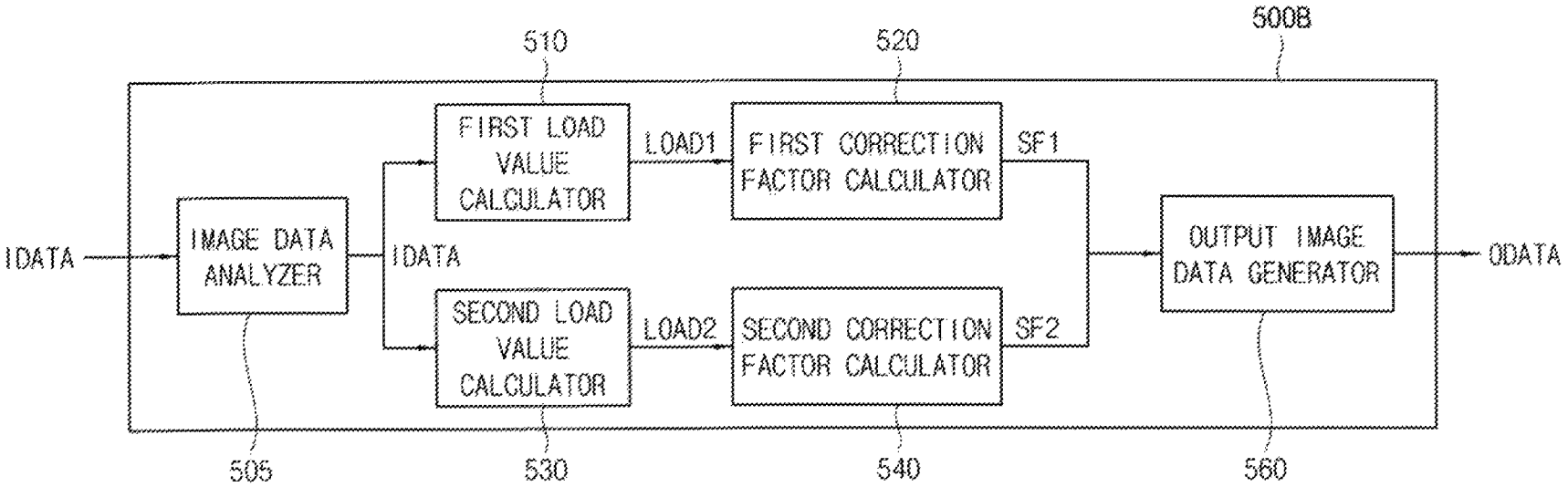
FIG. 10 is a block diagram illustrating a data adjuster included in an organic light emitting display device of FIG. 1, according to exemplary embodiments of the present invention.

FIG. 10 is a block diagram illustrating a data adjuster included in an organic light emitting display device of FIG.

Figure 11:
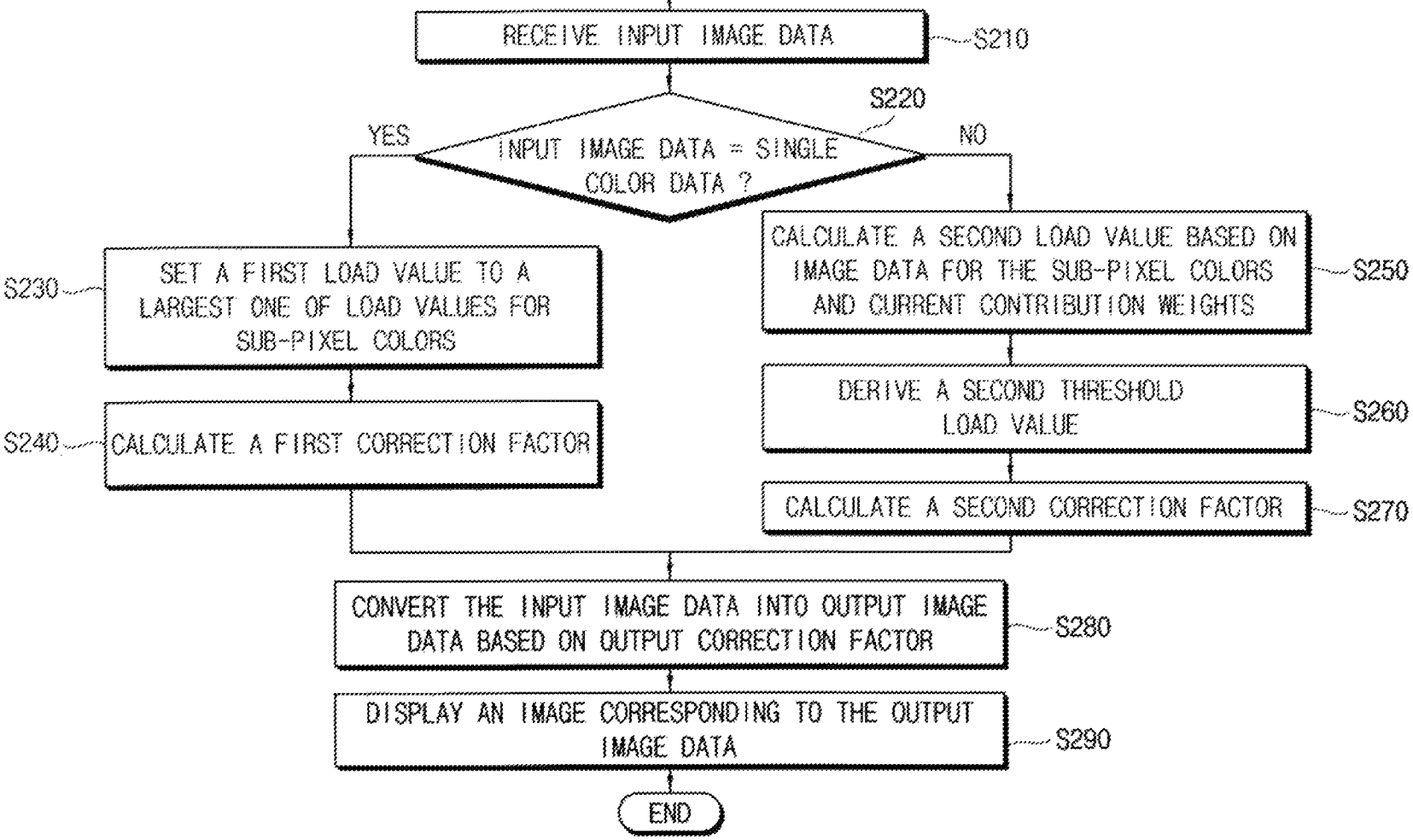
FIG. 11 is a flow chart illustrating a method of driving an organic light emitting display device performed by a data adjuster of FIG. 10, according to exemplary embodiments of the present invention.

1 according to exemplary embodiments of the present invention. FIG. 11 is a flow chart illustrating a method of driving an organic light emitting display device performed by a data adjuster of FIG. 10 according to exemplary embodiments of the present invention.

Referring to FIGS. 10 and 11, the data adjuster 500B may include an image data analyzer 505, a first load value calculator 510, a first correction factor calculator 520, a second load value calculator 530, a second correction factor calculator 540, and an output image data generator 560. The data adjuster 500B, according to an exemplary embodiment of the present invention, is substantially the same as the data adjuster described above with respect to FIG. 2, except that the image data analyzer 505 is added and the correction factor selector is excluded. Therefore, the same reference numerals will be used to refer to the same or like parts as those described in the previous exemplary embodiment of FIG. 2, and any omitted explanation may be assumed to be similar to or the same as the explanation provided with respect to FIG. 2.

The data adjuster 500B may receive input image data IDATA (S210).

The image data analyzer 505 may determine whether the input image data IDATA correspond to single color data or mixed color data (S220). For example, the image data analyzer 505 may determine whether the input image data IDATA correspond to red color data, green color data, blue color data, or white color data. The image data analyzer 505 may provide the input image data IDATA to the first load value calculator 510 to calculate the correction factor using the maximum load manner when the input image data IDATA correspond to the single-color data. The image data analyzer 505 may provide the input image data IDATA to the second load value calculator 530 to calculate the correction factor using the current contribution manner when the input image data IDATA correspond to the mixed color data.

When the input image data IDATA correspond to the single-color data, the first load value calculator 510 may set a first load value LOAD1 to a largest load value for sub-pixel colors of the input image data IDATA (S230). The first correction factor calculator 520 may calculate a first correction factor SF1 that decreases as the first load value increases, when the first load value LOAD1 is greater than a first threshold load value (S240). A method of deriving the first correction factor SF1 using the maximum load manner by the first load value calculator 510 and the first correction factor calculator 520 may be similar to the approach described above.

When the input image data IDATA correspond to the mixed color data, the second load value calculator 530 may calculate a second load value based on image data for the sub-pixel colors of the input image data IDATA and current contribution weights for the sub-pixel colors (S250). The second correction factor calculator 540 may derive a second threshold load value corresponding to a threshold current value (S260) and may calculate a second correction factor SF2 that decreases as the second load value LOAD2 increases, when the second load value LOAD2 is greater than a second threshold load value (S270). A method of deriving the second correction factor SF2 using the current contribution manner by the second load value calculator 530 and the second correction factor calculator 540 may be similar to the approach described above.

The output image data generator 560 may convert the input image data IDATA into the output image data ODATA based on the first correction factor SF1 or the second correction factor SF2 (S280).

The display panel may display an image corresponding to the output image data ODATA (S290).

Figure 12:
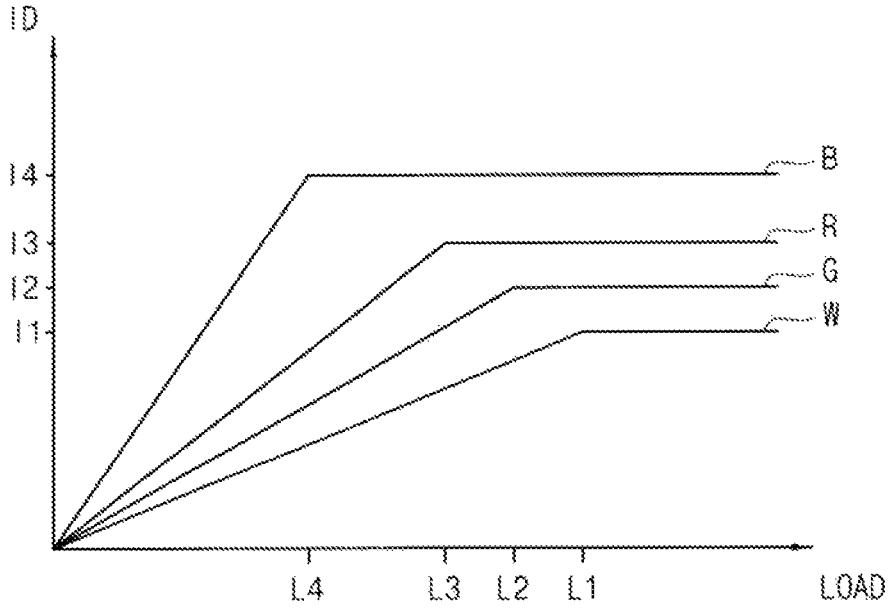
FIG. 12 is a graph illustrating the restriction of a driving current according to input image data, according to exemplary embodiments of the present invention.

FIG. 12 is a graph for describing illustrating a driving current restricted according to input image data according to exemplary embodiments of the present invention.

Referring to FIG. 12, the first threshold load value may be set to a different value for each of the sub-pixel colors when the input image data correspond to the single-color data. For example, because emission efficiencies of white color sub-pixel (W) and green color sub-pixel (G) are relatively high, the magnitude of the driving current ID may be relatively small (e.g., the first current value I1 and the second current value I2, respectively) in the same load value when the input image data correspond to white color data or green color data. Accordingly, to increase the visibility for the white color pattern or green color pattern, the first threshold load value for the white color sub-pixel (W) may be set to the first threshold value L1 and the first threshold load value for the green color sub-pixel (G) may be set to the second threshold value L2, respectively. Because emission efficiencies of red color sub-pixel (R) and blue color sub-pixel (B) are relatively low, the magnitude of the driving current ID may be relatively large (e.g., the third current value I3 and the fourth current value I4, respectively) in the same load value when the input image data correspond to red color data or blue color data. Accordingly, the first threshold load value for the red color sub-pixel (R) may be set to the third threshold value L3 and the first threshold load value for the blue color sub-pixel (B) may be set to the fourth threshold value LA that is lower than the second threshold value L2, respectively.

Therefore, when the input image data correspond to the single-color data, the visibility for the single-color pattern can be increased by adjusting the first threshold load value for each sub-pixel color.

Although an organic light emitting display device and a method of driving the organic light emitting display device using the method, according to exemplary embodiments of the present invention have been described with reference to figures, those skilled in the art will readily appreciate that many modifications are possible in the example embodiments without materially departing from the teachings and aspects of the present disclosure. For example, although the exemplary embodiments of the present invention describe that each pixel includes a red color sub-pixel, a green color sub-pixel, a blue color sub-pixel, and a white color sub-pixel, a structure of each pixel is not limited thereto.

The present inventive concept may be applied to an electronic device having the organic light emitting display device. For example, the present inventive concept may be applied to a cellular phone, a smart phone, a tablet computer, a personal digital assistant (PDA), etc.

What is claimed is:

1. A method of driving an organic light emitting display device, the method comprising:

receiving input image data representing an image comprising a plurality of pixels, each of the plurality of pixels comprising a plurality of sub-pixels;

determining load values for each of the plurality of sub-pixels for each of the plurality of pixels based on the received input image data;

setting a first load value as equal to a largest one of the load values determined for each of the plurality of sub-pixels for each of the plurality of pixels;

calculating a first correction factor that decreases as the first load value increases, when the first load value is greater than a first threshold load value;

calculating a second load value based on the input image data representing the plurality of sub-pixels of the plurality of pixels and current contribution weights for the plurality of sub-pixels;

calculating a second correction factor that decreases as the second load value increases, when the second load value is greater than a second threshold load value;

selecting either the first correction factor or the second correction factor as an output correction factor;

converting the input image data into output image data based on the output correction factor; and displaying an image corresponding to the output image data.

2. The method of claim 1, wherein the second threshold load value is determined such that a first ratio of a threshold current value to an estimated current value corresponding to the first threshold load value is substantially the same as a second ratio of the second threshold load value to the first threshold load value.

3. The method of claim 1, wherein the output correction factor is determined as a smaller one of the first correction factor and the second correction factor.

4. The method of claim 1, further comprising: determining whether the input image data correspond to single-color data or mixed-color data.

5. The method of claim 4, wherein the output correction factor is determined to be equal to the first correction factor when the input image data correspond to the single-color data and the output correction factor is determined to be equal to the second correction factor when the input image data correspond to the mixed-color data.

6. The method of claim 4, wherein the first threshold load value is set to a different value for each of the sub-pixels of the plurality of sub-pixels of the plurality of pixels when the input image data correspond to the single-color data.

7. The method of claim 1, wherein the first correction factor is set to 1 when the first load value is smaller than or equal to the first threshold load value and is set to a value derived by dividing the first threshold load value by the first load value when the first load value is greater than the first threshold load value.

8. The method of claim 1, wherein the second correction factor is set to 1 when the second load value is smaller than or equal to the second threshold load value and is set to a value derived by dividing the second threshold load value by the second load value when the second load value is greater than the second threshold load value.

9. The method of claim 1, wherein the second load value is set to a weighted average value of image data for each of the sub-pixels of the plurality of sub-pixels of the plurality of pixels and the current contribution weights for the plurality of sub-pixels.

10. The method of claim 1, wherein the output image data are generated by multiplying the input image data by the output correction factor.

11. The method of claim 1, wherein the plurality of sub-pixels of the plurality of pixels includes red-colored sub-pixels, green-colored sub-pixels, blue-colored sub-pixels, and white-colored sub-pixels.

12. An organic light emitting display device comprising:

a display panel including a plurality of pixels;

a scan driver configured to provide a scan signal to each of the plurality of pixels;

a data driver configured to provide a data signal to each of the plurality of pixels;

a data adjuster configured to set an output correction factor such that a constant driving current flows through the display panel when a load value of input image data provided thereto is greater than a selected one of threshold load values, and configured to convert the input image data into output image data based on the output correction factor; and a timing controller configured to control the scan driver and the data driver to display an image corresponding to the output image data on the display panel, wherein the data adjuster further includes and image data analyzer configured to determine whether the input image data correspond to single-color data or mixed-color data, wherein the data adjuster includes:

a first load value calculator configured to set a first load value to a largest load value for sub-pixels of the input image data;

a first correction factor calculator configured to calculate a first correction factor that decreases as the first load value increases when the first load value is greater than a first threshold load value of the threshold load values;

a second load value calculator configured to calculate a second load value based on image data for the sub-pixel colors of the input image data and current contribution weights for the sub-pixels;

a second correction factor calculator configured to calculate a second correction factor that decreases as the second load value increases when the second load value is greater than a second threshold load value of the threshold load values; and an output image data generator configured to generate the output image data by multiplying the input image data by the output correction factor, and wherein the output correction factor is set as equal to either the first correction factor or the second correction factor.

13. The display device of claim 12, wherein the second threshold load value is determined such that a first ratio of a threshold current value to an estimated current value corresponding to the first threshold load value is substantially the same as a second ratio of the second threshold load value to the first threshold load value.

14. The display device of claim 12, wherein, the data adjuster further includes: a correction factor selector configured to select a smaller one of the first correction factor and the second correction factor as the output correction factor.

15. The display device of claim 12, wherein the output correction factor is determined as the first correction factor when the input image data correspond to the single-color data and is determined as the second correction factor when the input image data correspond to the mixed color data.

16. The display device of claim 12, wherein the first threshold load value is set to a different value for each of the sub-pixels when the input image data correspond to the single color data.

17. The display device of claim 12, wherein the first correction factor calculator sets the first correction factor to 1 when the first load value is smaller than or equal to the first threshold load value and sets the first correction factor to a value derived by dividing the first threshold load value by the first load value when the first load value is greater than the first threshold load value.

* * * * *